US008878767B2

(12) United States Patent
Fletcher et al.

(10) Patent No.: US 8,878,767 B2
(45) **Date of Patent: *Nov. 4, 2014**

(54) SYSTEM AND METHOD FOR ADJUSTING A BACKLIGHT LEVEL BY CALCULATING A RUNNING AVERAGE OF PIXEL INTENSITY FOR A DISPLAY ON AN ELECTRONIC DEVICE

(75) Inventors: Bergen Fletcher, New Westminster (CA); Robert Lowles, Waterloo (CA); James Robinson, Elmira (CA)

(73) Assignee: BlackBerry Limited, Waterloo, Ontario (CA)

( * ) Notice: Subject to any disclaimer, the term of this patent is extended or adjusted under 35 U.S.C. 154(b) by 409 days.

This patent is subject to a terminal disclaimer.

(21) Appl. No.: 12/852,284

(22) Filed: Aug. 6, 2010

(65) Prior Publication Data

US 2010/0315450 A1 Dec. 16, 2010

Related U.S. Application Data

(63) Continuation of application No. 11/353,014, filed on Feb. 14, 2006, now Pat. No. 7,821,490.

(51) Int. Cl.
*G09G 3/36* (2006.01)
*G09G 3/34* (2006.01)

(52) U.S. Cl.
CPC ..... *G09G 3/3406* (2013.01); *G09G 2360/16* (2013.01); *G09G 2320/064* (2013.01); *G09G 2360/144* (2013.01); *G09G 2330/021* (2013.01)
USPC ..... 345/102; 345/89; 345/690

(58) Field of Classification Search
USPC ..... 345/102, 89, 690
See application file for complete search history.

(56) References Cited

U.S. PATENT DOCUMENTS

| | | | | |
|---|---|---|---|---|
| 7,139,022 | B1 | 11/2006 | Raffy | |
| 7,821,490 | B2 * | 10/2010 | Fletcher et al. | 345/102 |
| 2001/0033260 | A1 | 10/2001 | Nishitani et al. | |
| 2002/0130892 | A1 | 9/2002 | Holtslag | |

(Continued)

FOREIGN PATENT DOCUMENTS

| | | |
|---|---|---|
| EP | 0851323 A1 | 7/1998 |
| EP | 1217598 | 6/2002 |
| JP | 03179886 | 5/1991 |

OTHER PUBLICATIONS

Zheng Gu ed. Management Science Application in Tourism and Hospitality. 2004. Haworth Press. vol. 16. p. 77.

*Primary Examiner* — Long D Pham
(74) *Attorney, Agent, or Firm* — McCarthy Tétrault LLP

(57) ABSTRACT

The disclosure provides a system and method for adjusting a backlight level for an image being displayed on an electronic device. The system comprises: a display for displaying an image to be backlit; memory storing a numeric representation of the image on a pixel-by-pixel basis; and a backlight adjustment module to calculate a pixel-by-pixel, running average of an intensity of the image using the numeric representation and to determine a backlight level for the image using the running average, the running average being calculated according to an equation that calculates a new average using a previous average and a current pixel intensity value to avoid an overflow condition when calculating the running average.

20 Claims, 8 Drawing Sheets

(56) References Cited

U.S. PATENT DOCUMENTS

2003/0146919 A1 8/2003 Kawashima et al.
2004/0017938 A1* 1/2004 Cooper et al. ..... 382/171
2004/0257318 A1 12/2004 Itoh
2004/0263456 A1 12/2004 Miyachi et al.
2006/0001641 A1 1/2006 Degwekar et al.
2006/0007107 A1 1/2006 Ferguson
2006/0050159 A1* 3/2006 Ahn ..... 348/272
2006/0256067 A1 11/2006 Montero et al.

* cited by examiner

```
Define Number_Of_Pixels_On_Display = Display_Height_Pixels * Display_Width_Pixels


For i = 1 to Number_Of_Pixels_On_Display
        red_value = GetRedValue(i);
        green_value = GetGreenValue(i);
        blue_value = GetBlueValue(i);
        green_value>>1    ;    //shift right by one bit
        grey_value = 0.3 * red_value + 0.59 * green_value + 0.11 * blue_value;
        average_grey_value = RunningAverage(average_grey_value, grey_value, i);


Next i
gamma_corrected_value = (average_grey_value * average_grey_value) /
(grey_colour_depth * grey_colour_depth);
backlight_percent = 100 – (gamma_corrected_value * 100);
adjusted_backlight_percent = backlight_percent * (Max_Backlight_Percent –
Min_Backlight_Percent) / 100;


Function RunningAverage(average_value, new_value, total_values_in_average)
        return average_value – ((average_value – new_value)/total_values_in_average):
End Function
```

Fig. 4

Figure 6A
600
| Image Number | Backlight intensity (where 0% is off, and 100% is full power) |
|---|---|
| Image 1: Third darkest image (fourth brightest image) | |
| 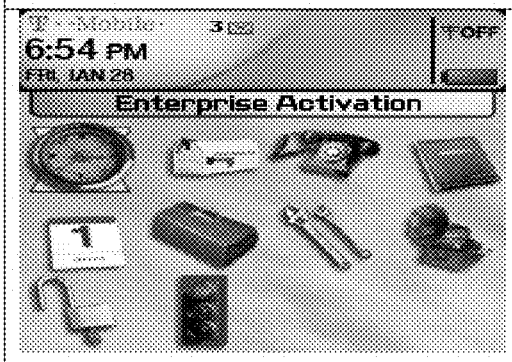 | 74% |
602
| Image 2: Fifth darkest image (second brightest image) | |
|---|---|
| 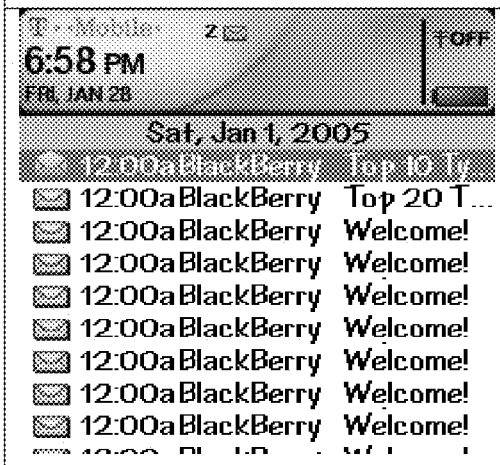 | 61% |

Figure 6B

604

| Image 3: Fourth darkest image (third brightest image) | |
|---|---|
| 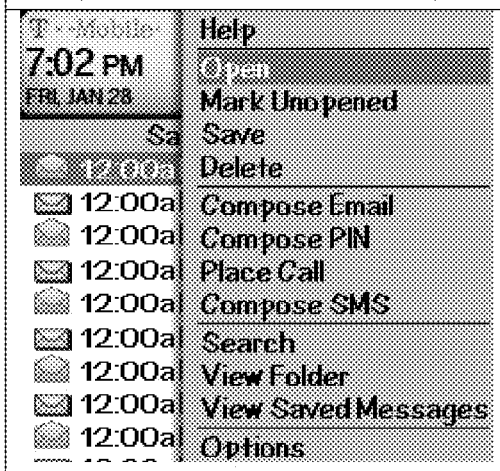  | 68% |

606

| Image 4: Least dark image (Brightest image) | |
|---|---|
| From: BlackBerry<br>Subject: Top 10 Typing Tips<br>You can find more typing tips in the on handheld help. In the menu of any program, click Help. You can also refer to the printed documentation that accompanied your handheld or the online User Guide for typing tips.<br><br>1. To type in a field using assisted typing, you only need to press keys one time for each letter. Try to type the whole word before you make | 54% |

Figure 6C
608
| Image 5: Second darkest image (Fifth brightest image) | |
|---|---|
| 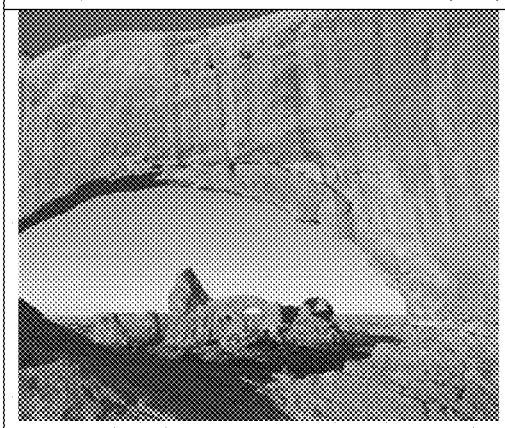 | 81% |
610
| Image 6: Darkest Image (Least bright image) | |
|---|---|
| 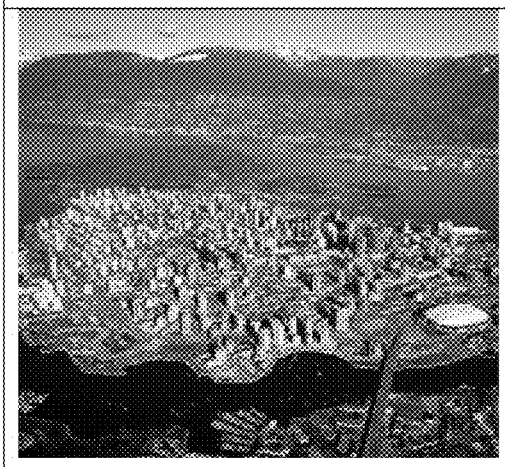 | 91% |

SYSTEM AND METHOD FOR ADJUSTING A BACKLIGHT LEVEL BY CALCULATING A RUNNING AVERAGE OF PIXEL INTENSITY FOR A DISPLAY ON AN ELECTRONIC DEVICE

RELATED APPLICATION

This application is a continuation patent application of U.S. patent application Ser. No. 11/353,014, filed on Feb. 14, 2006 now U.S. Pat. No. 7,821,490.

FIELD OF DISCLOSURE

The disclosure described herein relates to a system and method for controlling and adjusting a backlight level for a display on an electronic device. In particular, the disclosure described herein relates to controlling the backlight level by determining a current intensity of an image being shown on the display.

BACKGROUND OF THE DISCLOSURE

Current wireless handheld mobile communication devices perform a variety of functions to enable mobile users to stay current with information and communications, such as e-mail, corporate data and organizer information while they are away from their desks. A wireless connection to a server allows a mobile communication device to receive updates to previously received information and communications. The handheld devices optimally are lightweight, compact and have long battery life.

Current devices are used in all types of ambient environments. In different environments, e.g. lightly or dimly lit environments, different amounts of backlighting may be needed. This may also be valid for the type of image, colourwise, that is being displayed. Present systems do not adjust the backlight level to adjust for the brightness of the currently displayed image.

There is a need for a system and method which addresses deficiencies in the prior art.

BRIEF DESCRIPTION OF THE DRAWINGS

The disclosure will now be described, by way of example only, with reference to the accompanying drawings, in which:

FIG. 4 is an extract of exemplary pseudocode to implement the algorithm of FIG. 3;

FIGS. 6A-6C are diagrams illustrating exemplary images generated on the display processed according to an embodiment.

DETAILED DESCRIPTION OF AN EMBODIMENT

Figure 1:
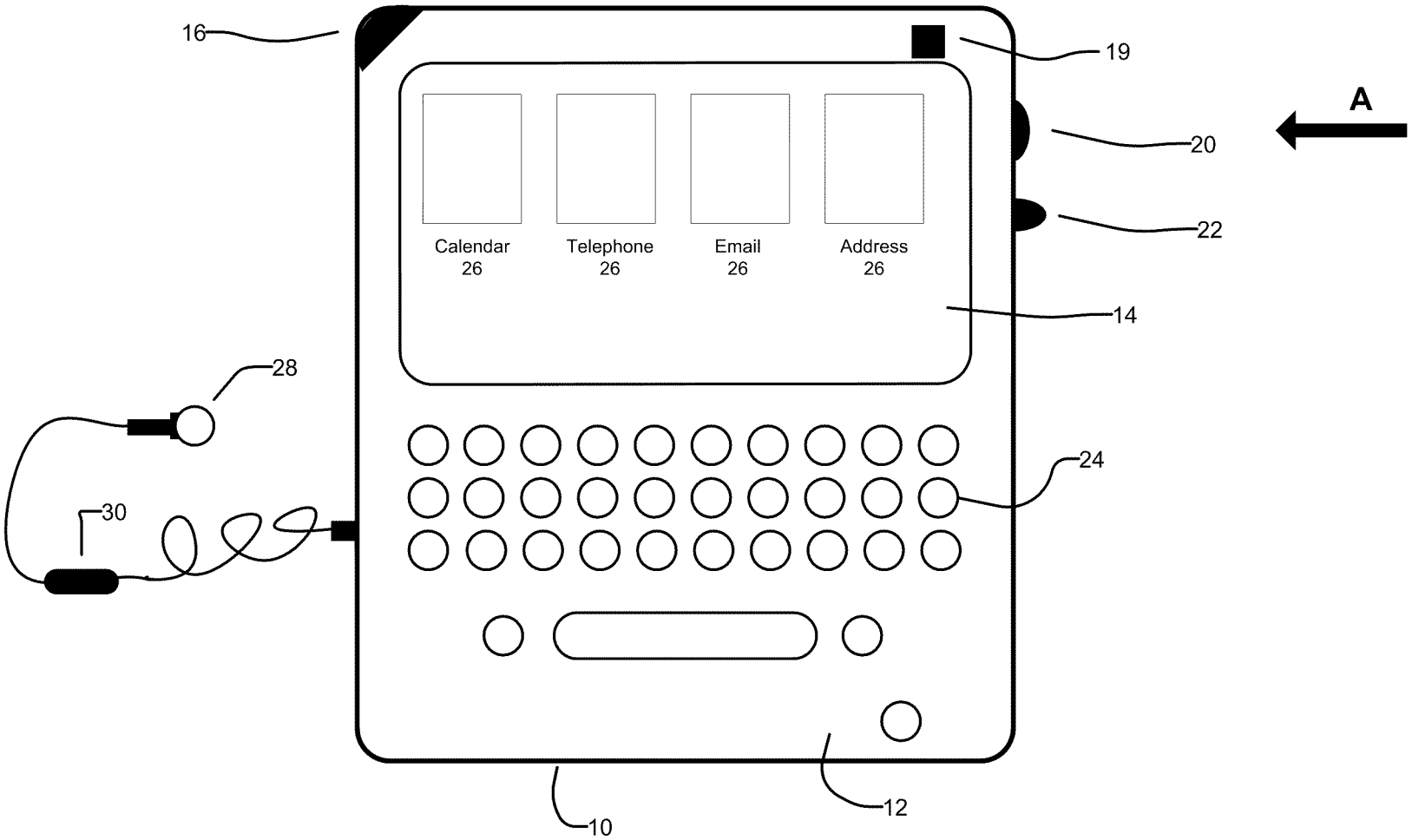
FIG. 1 is a schematic representation of an electronic device having a display and a background light adjustment system for the display in accordance with an embodiment.

The description which follows and the embodiments described therein are provided by way of illustration of an example or examples of particular embodiments of the principles of the present disclosure. These examples are provided for the purposes of explanation and not limitation of those principles and of the disclosure. In the description which follows, like parts are marked throughout the specification and the drawings with the same respective reference numerals.

In a first aspect, a backlight system for an electronic device is provided. The system comprises: a display for displaying an image to be backlit; memory storing a numeric representation of the image on a pixel-by-pixel basis; and a backlight adjustment module to calculate a pixel-by-pixel, running average of an intensity of the image using the numeric representation and to determine a backlight level for the image using the running average, the running average being calculated according to an equation that calculates a new average using a previous average and a current pixel intensity value to avoid an overflow condition when calculating the running average.

In the system, the equation may comprise $$A_N = A_{N-1} - \frac{A_{N-1} - X}{N}$$

where, $A_N$ is the new running average, $A_{N-1}$ is the previous running average, X is the new value added to the running average, and N is the number of pixels included in the running average so far.

The system may further comprise a backlight control system to provide a backlight for the display, the backlight control system responsive to control signals generated by the backlight adjustment module based on the running average and to a signal representing an amount of ambient light detected around the device to further adjust the backlight level to decrease the backlight level when the amount of ambient light is low and to increase the backlight level when the amount of ambient light is high up to a threshold and then to turn the backlight off.

In the system, calculating the running average may utilize a greyscale value associated with the image that has been corrected according to a gamma curve.

In the system, the greyscale value may provide a weight to favour green values in the image.

In the system, another calculation may be made for another average intensity for another image when the image is replaced by the another image on the display.

In the system, the image and the another image may relate to a video signal.

In the system, the darker the image, then the backlight level may be greater.

In a second aspect, a method of adjusting a backlight for a display for an electronic device is provided. The method comprises: calculating a pixel-by-pixel, running average of an intensity of an image being generated on the display using a numeric representation of the image, the running average being calculated according to an equation that calculates a new average using a previous average and a current pixel intensity value to avoid an overflow condition when calculating the running average; determining a backlight level for the image based on the running average; providing the backlight level to a backlight system for a display when the image is generated on the display; and monitoring an amount of ambient light detected around the device to further adjust the backlight level to decrease the backlight level when the amount of ambient light is low and to increase the backlight level when the amount of ambient light is high up to a threshold and then to turn the backlight off.

In the method, the equation may comprise $$A_N = A_{N-1} - \frac{A_{N-1} - X}{N}$$

wherein, $A_N$ is the new running average, $A_{N-1}$ is the previous running average, X is the new value added to the running average, and N is the number of pixels included in the running average so far.

In the method, calculating the running average may utilize a greyscale value associated with the image that has been corrected according to a gamma curve.

In the method, the greyscale value may provide a weight to favour green values in the image.

In the method, another calculation may be made for another image when the image is replaced by the another image on the display. Further, the another calculation may be made when the another image has changes over the image over more than a small portion of the image.

In the method, the display may be displaying a video image comprising the image and another image; and another calculation may be made for another running average for another image shown on the display after the image.

In a third aspect, a system for an electronic device is provided. The system comprises: a display for displaying an image to be backlit; a backlight adjustment module to calculate an average intensity of the image on a running average intensity from a greyscale value associated with the image corrected according to a gamma curve and to determine a backlight level for the image using data representing an amount of ambient light detected around the device and the running average intensity, the running average intensity being calculated according to an equation that calculates a new average using a previous average and a current pixel intensity value to avoid an overflow condition when calculating the running average; and a backlight system to provide a backlight for the display, the backlight system responsive to control signals generated by the backlight adjustment module, whereby the darker the image the greater is the backlight intensity.

In the system, the equation may comprise $$A_N = A_{N-1} - \frac{A_{N-1} - X}{N}$$

where, $A_N$ is the new running average, $A_{N-1}$ is the previous running average, X is the new value added to the running average, and N is the number of pixels included in the running average so far.

In the system, the running average may be computed by sequentially adding a greyscale pixel value to a running total.

In the system, the backlight level may be further responsive to a signal representing an amount of ambient light detected around the device such that as the amount of ambient light increases, the backlight level increases.

In the system, the greyscale value may be obtained from a weighted calculation in which green values are weighted most heavily.

In the system, another calculation may be made for another average intensity for another image when the image is replaced by the another image on the display.

In another aspect of an embodiment, a backlight system for an electronic device is provided. The system comprises: a backlight adjustment module to calculate an intensity value of an image; a display for displaying the image; and a backlight system to provide a backlight for the display. The backlight system is responsive to control signals generated by the backlight adjustment module. In the system, the intensity value represents an average intensity of the image.

In the system, the average intensity may be calculated from a greyscale value associated with the image and the greyscale value may have been corrected according to a gamma curve.

In the system, the average intensity may be calculated on a running average basis of pixels in the image.

In the system, the greyscale value may provide a weight to favour green colours in the image.

In the system, another calculation may be made for another intensity value for another image when the image is replaced on the display.

In the system, another calculation may be made for another intensity value for another image when the image is replaced by another image and if another image has changes over the image over more than a small portion of the display.

In another aspect, a method of adjusting a backlight for a display for an electronic device is provided. The method comprises: calculating an intensity value of an image; determining a backlight level for the image based on the intensity level; and providing the backlight level to a backlight system for a display when the image is generated on the display. In the method, the intensity value represents an average intensity of the image.

In the method, the average intensity may be calculated from a greyscale value associated with the image and the greyscale value may have been corrected according to a gamma curve.

In the method, the average intensity may be calculated on a running average basis of pixels in the image.

In the method, the greyscale value may provide a weight to favour green colours in the image.

In the method, another calculation may be made for another intensity value for another image when the image is replaced by the another image on the display. In the method, another calculation may be made for another intensity value for another image when the image is replaced by the another image and if the another image has changes over the image over more than a small portion.

In the method, the display may be displaying a video image comprising the image and another image; and another calculation may made for another intensity value for another image shown on said display after the image.

In other aspects, various sets and subsets of the above noted aspects are provided.

Referring to FIG. 1, an electronic device for receiving electronic communications in accordance with an embodiment of the disclosure is indicated generally at 10. In the present embodiment, electronic device 10 is based on a computing platform having functionality of an enhanced personal digital assistant with cellphone and e-mail features. It is, however, to be understood that electronic device 10 can be based on construction design and functionality of other electronic devices, such as smart telephones, desktop computers pagers or laptops having telephony equipment. In a present embodiment, electronic device 10 includes a housing 12, an LCD 14, speaker 16, an LED indicator 19, a trackwheel 20, an ESC ("escape") key 22, keypad 24, a telephone headset comprised of an ear bud 28 and a microphone 30. Trackwheel 20 and ESC key 22 can be inwardly depressed along the path of arrow "A" as a means to provide additional input to device 10.

It will be understood that housing 12 can be made from any suitable material as will occur to those of skill in the art and may be suitably formed to house and hold all components of device 10.

Device 10 is operable to conduct wireless telephone calls, using any known wireless phone system such as a Global System for Mobile Communications ("GSM") system, Code Division Multiple Access ("CDMA") system, Cellular Digital Packet Data ("CDPD") system and Time Division Multiple Access ("TDMA") system. Other wireless phone systems can include Bluetooth and the many forms of 802.11 wireless broadband, like 802.11a, 802.11b, 802.11 g, etc. that support voice. Other embodiments include Voice over IP (VoIP) type streaming data communications that can simulate circuit switched phone calls. Ear bud 28 can be used to listen to phone calls and other sound messages and microphone 30 can be used to speak into and input sound messages to device 10.

Various applications are provided on device 10, including email, telephone, calendar and address book applications. A GUI to activate these applications is provided on display 14 through a series of icons 26. Shown are calendar icon 26, telephone icon 26, email icon 26 and address book icon 26. Such applications can be selected and activated using the keypad 24 and/or the trackwheel 20. Further detail on selected applications is provided below.

Figure 2:
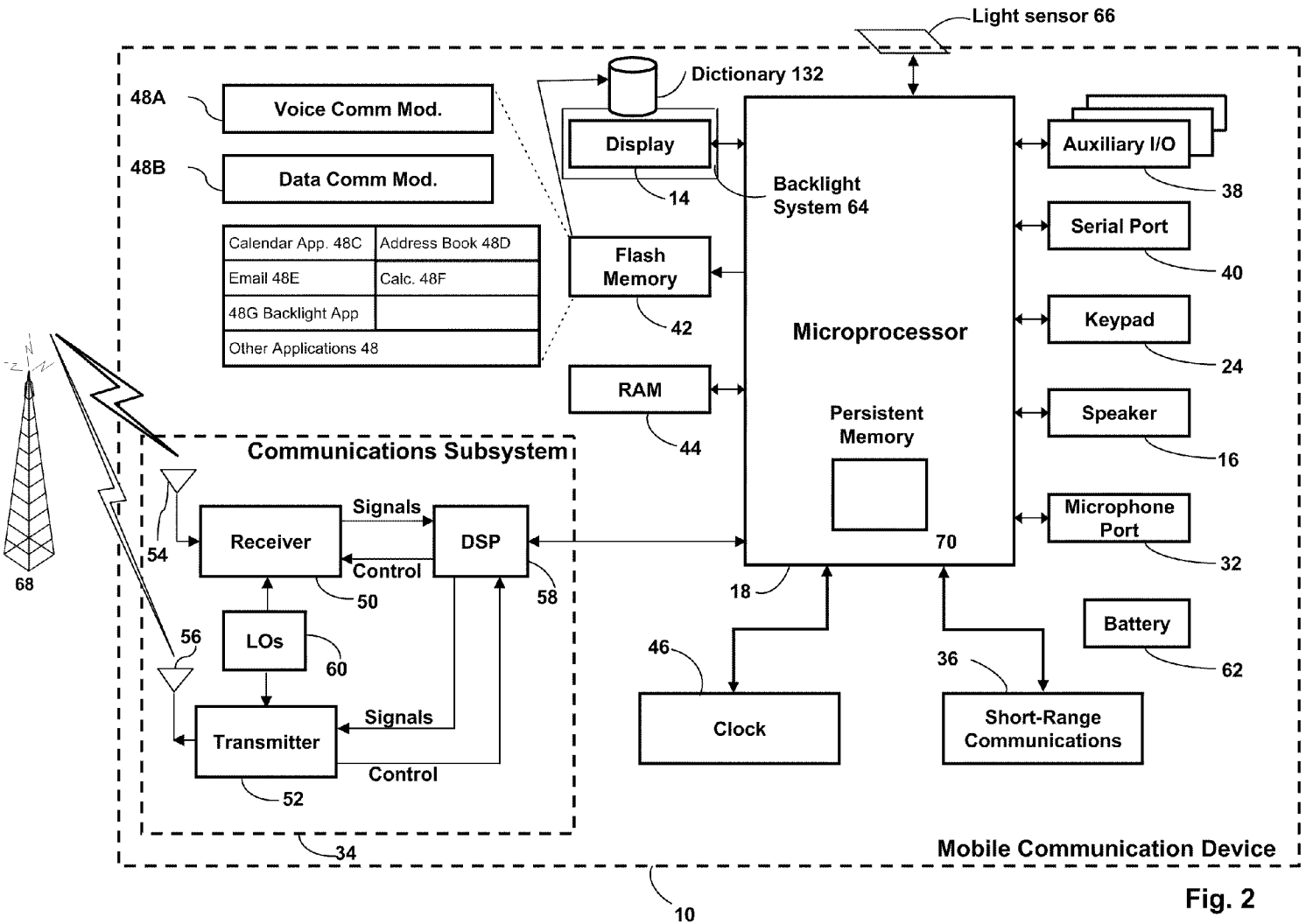
FIG. 2 is a block diagram of internal components of the device of FIG. 1 including the display and the background light adjustment system.

Referring to FIG. 2, functional elements of device 10 are provided. The functional elements are generally electronic or electro-mechanical devices. In particular, microprocessor 18 is provided to control and receive almost all data, transmissions, inputs and outputs related to device 10. Microprocessor 18 is shown schematically as coupled to keypad 24, display 14 and other internal devices. Microprocessor 18 controls the operation of the display 14, as well as the overall operation of the device 10, in response to actuation of keys on the keypad 24 by a user. Exemplary microprocessors for microprocessor 18 include Data 950 (trade-mark) series microprocessors and the 6200 series microprocessors, all available from Intel Corporation.

In addition to the microprocessor 18, other internal devices of the device 10 include: a communication subsystem 34; a short-range communication subsystem 36; keypad 24; and display 14; with other input/output devices including a set of auxiliary I/O devices through port 38, a serial port 40, a speaker 16 and a microphone port 32 for microphone 30; as well as memory devices including a flash memory 42 (which provides persistent storage of data) and random access memory (RAM) 44; clock 46 and other device subsystems (not shown). The device 10 is preferably a two-way radio frequency (RF) communication device having voice and data communication capabilities. In addition, device 10 preferably has the capability to communicate with other computer systems via the Internet.

Operating system software executed by microprocessor 18 is preferably stored in a computer readable medium, such as flash memory 42, but may be stored in other types of memory devices, such as read only memory (ROM) or similar storage element. In addition, system software, specific device applications, or parts thereof, may be temporarily loaded into a volatile storage medium, such as RAM 44. Communication signals received by the mobile device may also be stored to RAM 44.

Microprocessor 18, in addition to its operating system functions, enables execution of software applications on device 10. A set of software applications 48 that control basic device operations, such as a voice communication module 48A and a data communication module 48B, may be installed on the device 10 during manufacture or downloaded thereafter.

Communication functions, including data and voice communications, are performed through the communication subsystem 34 and the short-range communication subsystem 36. Collectively, subsystem 34 and subsystem 36 provide the signal-level interface for all communication technologies processed by device 10. Various other applications 48 provide the operational controls to further process and log the communications. Communication subsystem 34 includes receiver 50, transmitter 52 and one or more antennas, illustrated as receive antenna 54 and transmit antenna 56. In addition, communication subsystem 34 also includes processing module, such as digital signal processor (DSP) 58 and local oscillators (LOs) 60. The specific design and implementation of communication subsystem 34 is dependent upon the communication network in which device 10 is intended to operate. For example, communication subsystem 34 of the device 10 may be designed to operate with the Mobitex (trade-mark), DataTAC (trade-mark) or General Packet Radio Service (GPRS) mobile data communication networks and also designed to operate with any of a variety of voice communication networks, such as Advanced Mobile Phone Service (AMPS), Time Division Multiple Access (TDMA), Code Division Multiple Access CDMA, Personal Communication Service (PCS), Global System for Mobile Communication (GSM), etc. Communication subsystem 34 provides device 10 with the capability of communicating with other devices using various communication technologies, including instant messaging (IM) systems, text messaging (TM) systems and short message service (SMS) systems.

In addition to processing communication signals, DSP 58 provides control of receiver 50 and transmitter 52. For example, gains applied to communication signals in receiver 50 and transmitter 52 may be adaptively controlled through automatic gain control algorithms implemented in DSP 58.

In a data communication mode a received signal, such as a text message or web page download, is processed by the communication subsystem 34 and is provided as an input to microprocessor 18. The received signal is then further processed by microprocessor 18 which can then generate an output to the display 14 or to an auxiliary I/O port 38. A user may also compose data items, such as e-mail messages, using keypad 24, a thumbwheel associated with keypad 24, and/or some other auxiliary I/O device connected to port 38, such as a touchpad, a rocker key, a separate thumbwheel or some other input device. The composed data items may then be transmitted over communication network 68 via communication subsystem 34.

In a voice communication mode, overall operation of device 10 is substantially similar to the data communication mode, except that received signals are output to speaker 16, and signals for transmission are generated by microphone 30. Alternative voice or audio I/O subsystems, such as a voice message recording subsystem, may also be implemented on device 10.

Short-range communication subsystem 36 enables communication between device 10 and other proximate systems or devices, which need not necessarily be similar devices. For example, the short-range communication subsystem may include an infrared device and associated circuits and components, or a Bluetooth (trade-mark) communication module to provide for communication with similarly-enabled systems and devices.

Powering the entire electronics of the mobile handheld communication device is power source 62. Preferably, the power source 62 includes one or more batteries. More preferably, the power source 62 is a single battery pack, especially a rechargeable battery pack. A power switch (not shown) provides an "on/off" switch for device 10. Upon activation of the power switch an application 48 is initiated to turn on device 10. Upon deactivation of the power switch, an application 48 is initiated to turn off device 10. Power to device 10 may also be controlled by other devices and by internal software applications.

Display 14 has backlight system 64 to assist in the viewing display 14, especially under low-light conditions. A backlight system is almost invariably present in a LCD. A typical backlight system comprises a lighting source, such as a series of LEDs or a lamp located behind the LCD panel of the display, and a controller to control activation of the lighting source. The lamp may be fluorescent, incandescent, electroluminescent or any other suitable light source. As the lighting sources are illuminated, their light shines through the LCD panel providing backlight to the display. The intensity of the backlight level may be controlled by the controller by selectively activating a selected number of lighting sources (e.g. one, several or all LEDs) or by selectively controlling the activation duty cycle of the activated lighting sources (e.g. a duty cycle anywhere between 0% and 100% may be used).

To assist with one method of adjusting the backlight level, light sensor 66 is provided on device 10. Sensor 66 is a light sensitive device which converts detected light levels into an electrical signal, such as a voltage. It may be located anywhere on device 10, having considerations for aesthetics and operation characteristics of sensor 66. In one embodiment, an opening for light to be received by sensor 66 is located on the front cover of the housing of device 10 to reduce the possibility of blockage of the opening. In other embodiments, multiple sensors 66 may be provided and the software may provide different emphasis on signals provided from different sensors 66. The signal(s) provided by sensor(s) 66 can be used by a circuit in device 10 to determine when device 10 is in a well-lit, dimly lit or moderately-lit environment. This information can then be used to control backlight levels for display 14.

Brief descriptions are provided on the applications 48 stored and executed in device 10. Additional applications include calendar 48C which tracks appointments and other status matters relating to the user and device 10. Calendar 48C is activated by activation of calendar icon 26 on display 14. It provides a daily/weekly/month electronic schedule of appointments, meetings and events entered by the user. Calendar 48C tracks time and day data for device 10 using processor 18 and internal clock 46. The schedule contains data relating to the current accessibility of the user. For example it can indicate when the user is busy, not busy, available or not available. In use, calendar 48C generates input screens on device 10 prompting the user to input scheduled events through keypad 24. Alternatively, notification for scheduled events could be received via an encoded signal in a received communication, such as an e-mail, SMS message or voicemail message. Once the data relating to the event is entered, calendar 48C stores processes information relating to the event; generates data relating to the event; and stores the data in memory in device 10.

Address book 48D enables device 10 to store contact information for persons and organizations. Address book 48D is activated by activation of address book icon 26 on display 14. In particular, name, address, telephone numbers, e-mail addresses, cellphone numbers and other contact information is stored. The data can be entered through keypad 24 and is stored in an accessible a database in non-volatile memory, such as persistent storage 70, which is associated with microprocessor 18, or any other electronic storage provided in device 10.

Email application 48E provides modules to allow user of device 10 to generate email messages on device 10 and send them to their addressees. Application 48E also provides a GUI which provides a historical list of emails received, drafted, saved and sent. Text for emails can be entered through keypad 24. Email application 48E is activated by activation of email icon 26 on display 14.

Calculator application 48F provides modules to allow user of device 10 to create and process arithmetic calculations and display the results through a GUI.

Backlight adjustment application 48G is an image processing module and instructions to an image that is about to be displayed on display 14 to be analyzed for its intensity. Based on the intensity (or luminosity), a backlight level can be calculated and set for the image. As such, when the image is actually displayed on display 14, the backlight level can be appropriately set for the image. Backlight adjustment application can generate an appropriate signal, such as a pulse width modulation (PWM) signal or values for a PWM signal, that can be used to drive a backlight in backlight system 64 to an appropriate level. If backlight system 64 utilizes a duty cycle signal to determine a backlight level, application 48G can be modified to provide a value for such a signal, based on inputs received. Further detail on calculations conducted by application 48G are provided below.

Further detail is now provided on notable aspects of an embodiment. An embodiment provides a system and method for dynamically adjusting the lighting intensity of the backlight on display 14. As a backlight system for a display tends consume a large percentage of power required by a handheld device 10, using the backlight more efficiently can increase battery life for device 10. Backlight system 64 provides the lighting means to vary the intensity of the backlight provided to display 14. Backlight adjustment application 48G provides the software that controls the intensity of the backlight using various inputs and signals available to display 14 relating to an image that is currently generated on display 14. A basic algorithm provided by the embodiment is to first make a determination of an intensity of an image currently being displayed, then make any adjustment to the intensity to account for intensity characteristics of colours generated in the image and finally, adjusting a backlight level for the image being generated on the display based on the adjusted intensity. The intensity may be based on any type of intensity reading determined for the image. For example, an average intensity reading can be determined. Various types of averages can be used. Details of each are described in turn.

One feature of an embodiment is that the intensity of a backlight is dynamically calculated and adjusted as different images are displayed on display 14. This can have the effect of providing an efficient backlight value for each image, thereby reducing power consumption for backlight system 64 by adjusting its output to meet the current characteristics of the current image.

The embodiment utilizes difference in perceived brightness level in a displayed image versus the actual brightness level of the image. For example, an image having many dark pixels may appear to be less bright than an image having many lighter pixels. This apparent brightness level difference occurs because the liquid crystal in an LCD generally allows more light to pass through lighter pixels and less light passes through darker pixels. In an idealized image, all light would pass through a completely white image and no light would pass through a completely black image.

Figure 3:
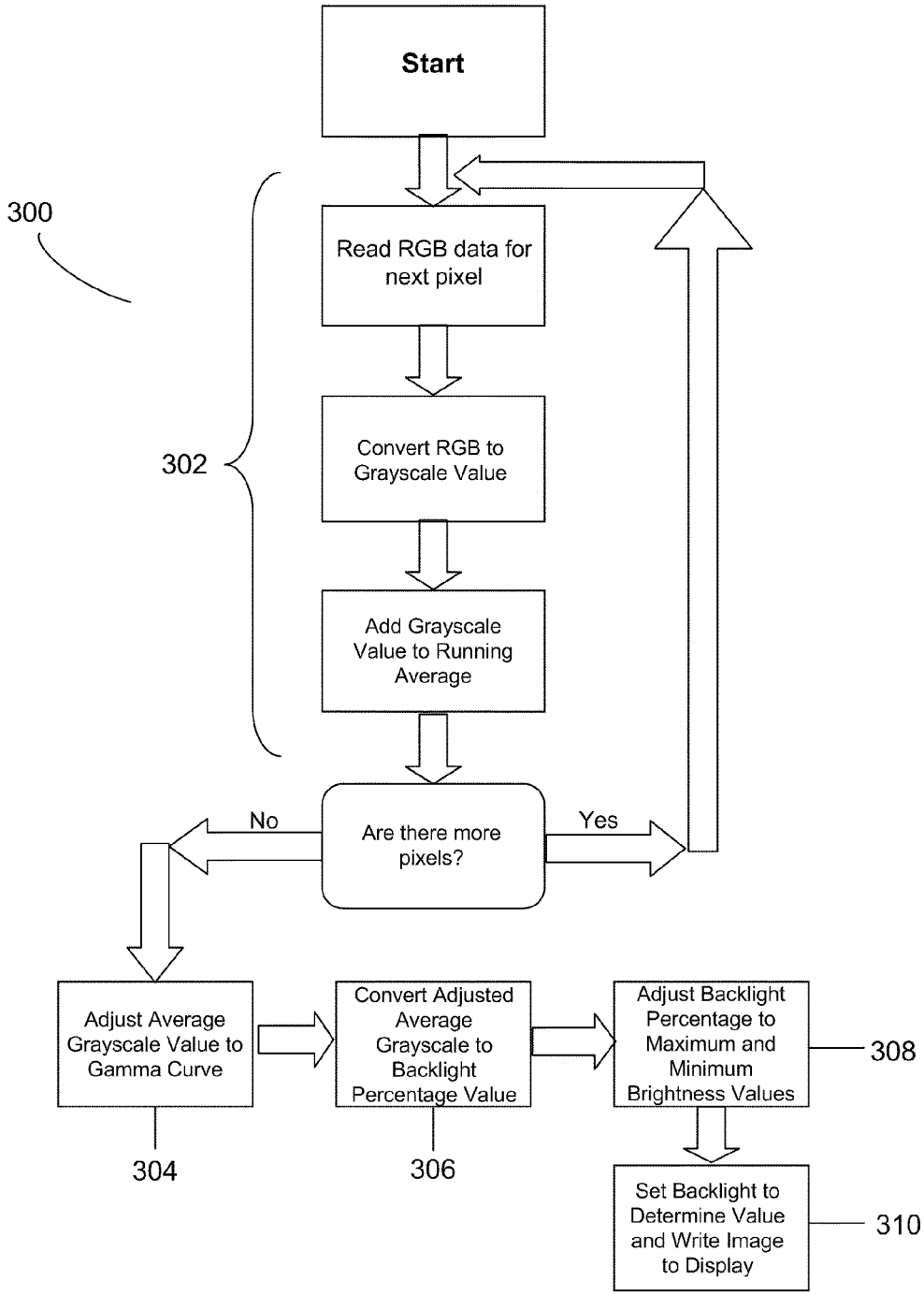
FIG. 3 is a flow chart of an algorithm executed by the backlight adjustment system of FIG. 1.

Referring to FIG. 3, further detail is provided on a calculation conducted by module 48G. Therein algorithm 300 comprises the above noted three main calculations: calculate an average greyscale value for an image in section 302; adjust a greyscale value in section 304; convert the adjusted greyscale value to a backlight percentage value in section 306; adjust the backlight values between minimum and maximum brightness values in section 308 and set the calculated backlight value and display the image in section 310. Each section is described in turn.

For section 302, an embodiment provides an algorithm implemented in software that executes on device 10 that calculates an average of greyscale values for an image being generated on display 14. The greyscale values are calculated as the image is read from memory or as the image is being written to the display 14. A greyscale value is derived from a photopic curve based calculation which combines three colour pixels (i.e. red, green and blue) into a single value. The average may be calculated on a running average basis, in order to minimize the processing of large numbers. As an image is being read from memory or as it is being written to the display the value of each pixel is computed into the running average. A conventional method of calculating an average is to first sum intensity values of all the pixels in an image and then to divide by the total number of pixels. This computational method introduces large numbers in the calculation method. As an alternative, an embodiment preferably sequentially adds a pixel value to a running average total. After every pixel value has been added to the total, the average value can be calculated by dividing by the total number of pixels.

For example, for a colour image having dimensions of 260×240 pixels, there are 62400 pixels. If each pixel is provided with a 5 bit greyscale pixel, then after converting the greyscale into a decimal number, the pixel greyscale value is between 0 and 31. For an example where an image in which every pixel is fully on, the greyscale of each pixel would be set at 31. During a conventional calculation of an average greyscale the running total of greyscale values would be 1934400 for an image the size of 260×240 pixels (i.e., image size× greyscale value of each pixel=260×240×31). This running total value would cause an overflow of a regular 16-bit unsigned integer, which typically has a maximum value of 65535.

As such, to avoid such an overflow condition, the embodiment uses an average calculation that calculates a running average per equation 1:

$$A_N = A_{N-1} - \frac{A_{N-1} - X}{N} \qquad \text{Equation 1}$$

Therein, $A_N$ is the new average, $A_{N-1}$ is the previous average, X is the new value added to the average, and N is the number of values included in the average so far. Exemplary pseudocode for Equation 1 is provided in FIG. 4.

As the display 14 generates images in colour, in order to provide an intensity value for the image that can be compared against other intensity values for other images, it is preferable to convert the net colour value for the image into a greyscale value. It is preferable to convert each RGB pixel value into a greyscale value in order to provide a common value to base a calculation on every pixel. For example, in a given image, a pixel that is green at a given intensity is more luminous that a pixel that is red at the same intensity. By converting all colour values for all pixels to a greyscale, such differences are smoothed out, since during the conversion process, the luminosity of different colours is preferably taken into consideration.

Further detail on a greyscale conversion is provided. In an exemplary display 14 in device 10, a colour format used is RGB 565, meaning that there are 32 levels of resolution for red in five bits, 64 levels for green in six bits and 32 levels for blue in five bits. For the greyscale conversion, a first step is to drop the least significant bit (LSB) of the green pixel, in order to normalize all bit values for the red, green, and blue colours. As such, each of the three colours is represented by a number between 0-31. Next, the values for the three colours are converted into a single greyscale value by a weighted calculation. The weighting of each pixel colour is based on the photopic curve. The human eye does not perceive all wavelengths of light equally: generally green wavelengths are perceived to be more intense than red and blue wavelengths. Therefore when converting a red-green-blue image to a greyscale image, the green value in the image is preferably most heavily weighted. A commonly used (NTSC Standard) weighting is provided in Equation 2:

$$\text{GRAY}=0.3\times\text{RED}+0.59\times\text{GREEN}+0.11\times\text{BLUE} \qquad \text{Equation 2}$$

It can be seen that the green value is most heavily weighted with a scaling factor of 0.59, the red value is next most heavily weighted with a scaling factor of 0.3 and the blue value is least heavily weighted with a scaling factor of 0.11. In other embodiments, other scaling factors may be used.

Next, for section 304 the value of the intensity is adjusted using a gamma curve correction factor. A gamma curve can be used to correct the brightness of all pixel colours lying between white and black. The gamma curve is provided in Equation 3:

$$y = \left(\frac{x}{\text{MAX}}\right)^{\gamma} \qquad \text{Equation 3}$$

where y is the gamma-corrected pixel value, x is the original pixel value, MAX is the maximum pixel value and γ is the gamma correction value. For the instance of a pixel having 5-bit colour resolution, MAX is 31. The gamma value of a typical LCD is about 2.2. In order to simplify mathematical calculations, a gamma value of may be used 2: calculating a non-integral power (e.g. $x^{2.2}$) requires more calculations and longer time than calculating an integral power (i.e. $x^2$). However, if an embodiment has sufficient processing power, other values may also be used.

Next, for section 306, the average greyscale value is converted into a percentage based on a minimum brightness level (the level that would be set for a completely white image) and a maximum brightness level (the level that would be set for a completely black image). Between the minimum and maximum levels, a parabolic curve is used to determine a brightness of all images between white and black. The curve may be based on the gamma curve, as known in the art.

Next, for section 308, a range of minimum and maximum brightness levels for backlight system 64 is provided in order to provide practical operational boundaries for the brightness level signals provided by backlight system 64. The boundaries may vary on the characteristics of each device 10 and each type of display 14 provided therein.

Finally for section 310, once all backlight parameters are set, all control signals for the backlight system 64 are provided by application 48G to backlight system (e.g. as a PWM signal or a duty cycle signal), and backlight system 64 provides a backlight intensity corresponding to the signal provided. At the same time, the image is written itself to display 14.

FIG. 4 provides a pseudo-code listing which may be used as a basis to implement flow chart 300 in software.

FIGS. 6A-6C show an exemplary set of results of processing various images by an embodiment. Therein, six images (600, 602, 604, 606, 608 and 610) are shown of varying colour intensities. The PWM signals shown in the right column represent the duty cycle calculated for a display 14 to provide sufficient and consistent backlighting among the six images when displayed on device 10.

As long as an image remains generated on display 14, the backlight level preferably remains the same. The embodiment describes providing backlight calculations for images that are static on display 14. For video images, an embodiment can utilize the same techniques described herein on a frame-by-frame basis. Alternatively, for video applications, the backlight calculations may be done on an interval basis, for example, once every 2, 3, 5, 10, 15, 20, 30 . . . frames. This interval may be based on the video CODEC used. Many CODECs only contain complete frame data only for one frame in an interval. Subsequent frames in the interval are composites of these full-data frames.

It will further be appreciated that for an electronic device, several static images may be displayed on device 10, even though minimal activity is apparent on device 10. For example, for a device that has a moveable displayed cursor, each instance of a movement of the cursor would cause a new image to be generated on display 14. As such, a new calculation may be done for each updated image. Also, a display on device 14 having a clock signal would be updated each time a digit changed on the clock signal. For such instances, if the change in the image affects only a relatively small portion of the entire screen, the system may selectively not conduct a recalculation of the intensity of the image.

The embodiment described herein provides an intensity calculation based on the entire display section of display 14. In other embodiments, different sections of display 14 may be used to calculate an average. For example, an average may be calculated based on alternating rows in display 14 or on a specific section of display 14 (e.g. its central area). Other averages may use only one or two of the colours (e.g. green and red, as they are the two most dominant colours). In other embodiments a combination of any of these alternative calculations may be used.

It will be appreciated that the embodiment can be used on monochrome displays. Therein, a greyscale value is already provided for the image being displayed on display 14.

In other embodiments, the intensity calculation provided above can be used with ambient lighting condition information provided by sensor 66 to make further adjustments to the intensity level.

Figure 5:
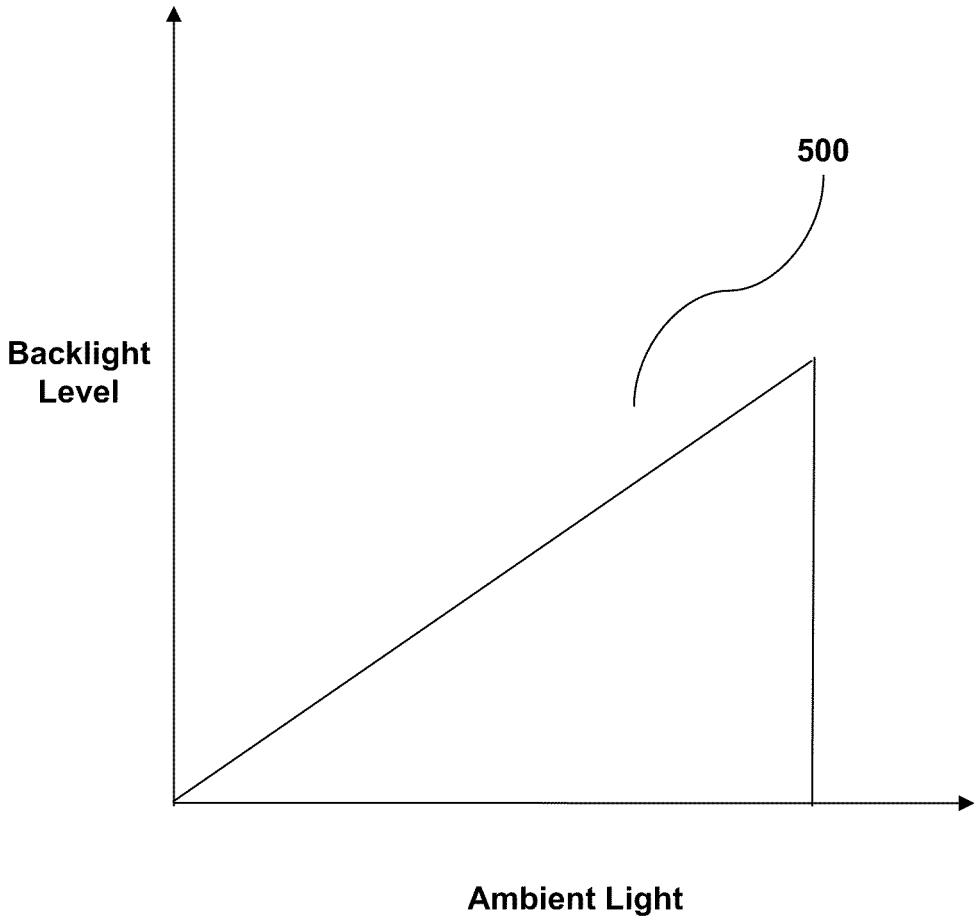
FIG. 5 is a graph illustrating a backlight intensity level for various ambient lighting conditions used by an embodiment of FIG. 1.

Referring to FIG. 5, graph 500 shows a backlight level for display 14 on the y-axis compared against a level of ambient light surrounding device 14 on the x-axis. As is shown, graph 500 has in a low backlight level when display 14 is in a very dark environment. As the amount of ambient light increases, the backlight level increases as well. Graph 500 provides a linear increase in backlight level intensity to as the amount of ambient light increases. At a certain point, the ambient light conditions are very bright and as such, the backlight may not be very effective in those conditions. As shown in graph 500, at that point, backlighting may be turned off. It will be appreciated that in other embodiments for other LCDs, other graphs of backlight level progressions may be used, including step-wise progressions and non-linear progressions. A backlight level progression may be expressed as a formula, which may be used by software to determine an appropriate control signal for the controller of the backlight system for a given level of ambient light. In other embodiments, a backlight level progression may be stored as a table providing a set of backlight levels for a corresponding set of ambient light levels. In other embodiments, a series of different adjustment algorithms may be used.

The present disclosure is defined by the claims appended hereto, with the foregoing description being merely illustrative of a preferred embodiment of the disclosure. Those of ordinary skill may envisage certain modifications to the foregoing embodiments which, although not explicitly discussed herein, do not depart from the scope of the disclosure, as defined by the appended claims.

The invention claimed is:

1. A backlight system for an electronic device, comprising:

a display for displaying an image to be backlit;

memory storing a numeric representation of the image on a pixel-by-pixel basis;

a backlight adjustment module to calculate a pixel-by-pixel, running average of an intensity of the image of alternating rows of the image in the numeric representation as the image is read from the memory or as the image is written to the display and to determine a backlight level for the image using the running average, the running average being calculated according to an equation that calculates a new running average using a previous running average and a current pixel intensity value of sequential pixels in the numeric representation to avoid an overflow condition when calculating the running average; and a backlight control system to provide a backlight for the display, the backlight control system responsive to control signals generated by the backlight adjustment module based on the running average and responsive to a signal representing an amount of ambient light detected around the device, the signal further adjusting a backlight level of the backlight from a low backlight level when the amount of ambient light is low and increasing the backlight level as the amount of ambient light increases up to a threshold and turning off the backlight when the amount of ambient light is over the threshold.

2. The backlight system for an electronic device as claimed in claim 1, wherein the equation comprises:

$$A_N = A_{N-1} - \frac{A_{N-1} - X}{N}$$

wherein, $A_N$ is the new running average, $A_{N-1}$ is the previous running average, X is the new value added to the running average, and N is the number of pixels included in the running average so far.

3. The backlight system for an electronic device as claimed in claim 2, wherein calculating the running average utilizes a greyscale value associated with the image that has been corrected according to a gamma curve.

4. The backlight system for an electronic device as claimed in claim 2, wherein another calculation is made for another average intensity for another image when the image is replaced by the another image on the display.

5. The backlight system for an electronic device as claimed in claim 4, wherein the image and the another image relate to a video signal.

6. The backlight system for an electronic device as claimed in claim 1, wherein:

the running average of the image uses only data for either red or green or both red and green colours in the numeric representation of the alternating rows of the image.

7. A method of adjusting a backlight for a display for an electronic device, comprising:

calculating a pixel-by-pixel, running average of an intensity of an image being generated on the display using alternating rows of the image in a numeric representation of the image, the running average being calculated according to an equation that calculates a new running average using a previous running average and a current pixel intensity value of sequential pixels in the numeric representation to avoid an overflow condition when calculating the running average;

determining a backlight level for the image based on the running average;

generating the backlight level to a backlight system for a display when the image is generated on the display; and adjusting the backlight level from a low backlight level when an amount of ambient light detected around the electronic device is low and increasing the backlight level to higher levels as the amount of ambient light increases to a threshold and turning off the backlight off when the amount of ambient light passes the threshold.

8. The method of adjusting a backlight for a display for an electronic device as claimed in claim 7, wherein the equation comprises:

$$A_N = A_{N-1} - \frac{A_{N-1} - X}{N}$$

$A_N$ is the new running average $A_N$ is the previous running average X is the new value added to the running average, and N is the number of pixels included in the running average so far.

9. The method of adjusting a backlight for a display for an electronic device as claimed in claim 8, wherein calculating the running average utilizes a greyscale value associated with the image that has been corrected according to a gamma curve.

10. The method of adjusting a backlight for a display for an electronic device as claimed in claim 8, wherein the greyscale value provides a weight to favour green values in the image.

11. The method of adjusting a backlight for a display for an electronic device as claimed in claim 8, wherein another calculation is made for another intensity value for another image when the image is replaced by the another image on the display and the another image has changes over the image over more than a small portion of the image.

12. The method of adjusting a backlight for a display for an electronic device as claimed in claim 8, wherein:

the display is displaying a video image comprising the image and another image; and another calculation is made for another running average for another image shown on the display after the image.

13. The method of adjusting a backlight for a display for an electronic device as claimed in claim 7, wherein:

the running average of the image uses only data for either red or green or both red and green colours in the numeric representation of the alternating rows of the image.

14. A system for an electronic device, comprising:

a display for displaying an image to be backlit;

a backlight adjustment module to calculate an average intensity of the image of alternating rows of the image on a running average intensity from a greyscale value associated with the image corrected according to a gamma curve and to determine a backlight level for the image using data representing an amount of ambient light detected around the device and the running average intensity, the running average intensity being calculated according to an equation that calculates a new running average using a previous running average and a current pixel intensity value of sequential pixels in the alternating rows of the image in the numeric representation to avoid an overflow condition when calculating the running average; and a backlight system to provide a backlight for the display, the backlight system responsive to control signals generated by the backlight adjustment module and responsive to an amount of ambient light detected around the electronic device, whereby pulse width modulation control signals are generated to provide the backlight at a low backlight level when the amount of ambient light is low and the backlight, to increase the backlight as the amount of ambient light increases up to a threshold and to turn off the backlight when the amount of ambient light passes the threshold.

15. The system for an electronic device as in claim 14, wherein the equation comprises:

$$A_N = A_{N-1} - \frac{A_{N-1} - X}{N}$$

wherein, $A_N$ is the new running average, $A_{N-1}$ is the previous running average, X is the new value added to the running average, and N is the number of pixels included in the running average so far.

16. The system for an electronic device as in claim 15, wherein the running average is computed by sequentially adding a greyscale pixel value to a running total.

17. The system for an electronic device as in claim 15, wherein the backlight level is further responsive to a signal representing an amount of ambient light detected around the device such that as the amount of ambient light increases, the backlight level increases.

18. The system for an electronic device as claimed in claim 15, wherein the greyscale value is obtained from a weighted calculation in which green values are weighted most heavily.

19. The system for an electronic device as claimed in claim 15, wherein another calculation is made for another average intensity for another image when the image is replaced by the another image on the display.

20. The system for an electronic device as in claim 14, wherein:

the running average of the image uses only data for either red or green or both red and green colours in the numeric representation of the alternating rows of the image.

* * * * *